US005456618A

United States Patent [19]

Nakamura

[11] Patent Number: 5,456,618

[45] Date of Patent: Oct. 10, 1995

[54] ELECTRICAL CONNECTOR

[75] Inventor: Masahiko Nakamura, Yao, Japan

[73] Assignee: Hosiden Corporation, Yao, Japan

[21] Appl. No.: 275,666

[22] Filed: Jul. 15, 1994

Related U.S. Application Data

[63] Continuation of Ser. No. 886,887, May 22, 1992, abandoned.

[30] Foreign Application Priority Data

Jun. 26, 1991 [JP] Japan ..... 3-048545 U

[51] Int. Cl.[6] ..... H01R 13/648

[52] U.S. Cl. ..... 439/610; 439/607

[58] Field of Search ..... 439/607–610, 439/98, 906

[56] References Cited

U.S. PATENT DOCUMENTS

| | | | |
|---|---|---|---|
| 4,497,533 | 2/1985 | Genova et al. | 439/610 |
| 4,557,545 | 12/1985 | Ohtsuki et al. | 439/906 |
| 4,981,447 | 1/1991 | Ichitsubo | 439/610 |
| 5,052,949 | 10/1991 | Lopata et al. | 439/610 |
| 5,088,932 | 2/1992 | Nakamura | 439/610 |
| 5,092,794 | 3/1992 | Kachlic | 439/610 |

FOREIGN PATENT DOCUMENTS

| | | | |
|---|---|---|---|
| 0090539 | 5/1983 | European Pat. Off. | 439/906 |
| 0012477 | 1/1989 | Japan | 439/610 |

*Primary Examiner*—Daniel W. Howell
*Assistant Examiner*—Hien D. Vu
*Attorney, Agent, or Firm*—Jones, Tullar & Cooper

[57] ABSTRACT

In the electrical connector of the present invention, the structure for assembling a shield frame unit and contact-piece members with the connector body meets the demand for a thinner electrical connector, and the shield-frame manufacturing step is simplified. The end surfaces of leg portions of U-shaped shield frames put on the body, abut on each other, the front ends of the frames are connected to each other with the use of engagement grooves of the body, and the rear ends of the frames are connected to each other as engaged with each other. Terminal portions of contact-piece members of the cantilever type are secured to the body, the tips of the contact-piece members resiliently come in contact with and are supported by contact-piece supporting walls, and contact areas projecting to the inside space of the body are formed in an arcuate shape at the contact-piece members.

10 Claims, 7 Drawing Sheets

ELECTRICAL CONNECTOR

This is a continuation of application Ser. No. 07/886,887 filed on May 22, 1992, now abandoned.

BACKGROUND OF THE INVENTION

1. Field of the Invention

The present invention relates to an electrical connector incorporating anti-noise measures by the use of a shield frame unit. Such an electrical connector is used as a socket.

2. Description of the Prior Art

FIG. 7 shows a conventional electrical connector of the type mentioned above. This conventional electrical connector has (i) a shield frame unit 100 comprising first and second shield frames 110, 120 each having a U-shaped section, and (ii) a body 200 having engagement grooves 210. The shield frames 110, 120 are provided with leg portions which have inwardly bent engagement pieces 111, 121, respectively. The engagement pieces 111, 121 overlap each other and are inserted into the engagement grooves 210, so that the two shield frames 110, 120 are secured to each other and surround the body 200.

In the electrical connector having the arrangement mentioned above, the engagement grooves 210 formed in the body 200 for securing the first and second shield frames 110, 120 to each other, prevent the walls of the body 200 from being thinned to make the electrical connector in a compact design. Further, it makes the shield-frame production step complicated to form the engagement pieces 111, 121 at the leg portions of the shield frames 110, 120 by inwardly bending the leg portions.

On the other hand, contact-piece members 300 incorporated in the body 200 have terminal portions 310 and contact-piece portions 320 forwardly extending therefrom. The contact-piece portions 320 are folded back to form contact areas 321. When the contact-piece members 300 are housed inside of the body 200, the terminal portions 310 of the contact-piece members 300 are secured to the body 200 and the contact-piece portions 320 are disposed, as cantilevered, in the inside space of the body 200. It can be said that such an electrical connector where the contact-piece portions 320 are cantilevered in the inside space of the body 200, is of the cantilever type.

In the cantilever-type electrical connector, when the contact areas 321 are formed by folding back the contact-piece portions 320 of the contact-piece members 300, it is necessary to form spaces for housing the folded back portions in the body 200. Accordingly, the walls of the body 200 should be thickened, thus preventing the making of the electrical connector in a compact design.

SUMMARY OF THE INVENTION

In view of the foregoing, the present invention is proposed.

It is an object of the present invention to provide an electrical connector in which the structure for assembling a shield frame unit and contact-piece members with the connector body manages to meet the demand for a thinner electrical connector.

It is another object of the present invention to provide an electrical connector in which the shield-frame manufacturing step is simplified.

It is a further object of the present invention to provide an electrical connector in which provision is made for preventing resin from entering inside of the shield frame unit when insert-molding the shield frame unit and a resin molded body.

It is still another object of the present invention to provide an electrical connector improved in the shielding performance of the shield frame unit.

To achieve the objects mentioned above, the electrical connector in accordance with an embodiment of the present invention comprises:

a body made in the form of a hollow rectangular parallelepiped;

contact-piece members incorporated in the body adapted to be contacted with the contacts of a counter mating electrical connector inserted into the inside or interior space of the body;

an edge frame formed at the outer peripheral walls of the front end of the body, the edge frame projecting outwardly from the body;

engagement grooves formed in opposite walls of the edge frame, the engagement grooves being concaved or recessed in the direction from the rear end of the the edge frame to the front end thereof;

a first shield frame made in a U-shape and comprising, in a unitary structure, a plate-like portion, a pair of leg portions inwardly projecting from the longitudinal edges of the plate-like portion throughout the length thereof, a first mounting portion put on one-half of the periphery of the body, and a first fixing portion located at the rear side of the first mounting portion, the first fixing portion being provided at the leg portions thereof with engagement portions; and a second shield frame made in a U-shape and comprising, in a unitary structure, a plate-like portion, a pair of leg portions inwardly projecting from the longitudinal edges of the plate-like portion throughout the length thereof, a second mounting portion put on the other one-half of the periphery of the body, and a second fixing portion located at the rear side of the second mounting portion, the second fixing portion being provided in the leg portions thereof with portions to be engaged corresponding to the engagement portions of the first fixing portion;

the end surfaces of the leg portions of the first mounting portion, abutting on the end surfaces of the leg portions of the second mounting portion;

the second fixing portion being overlappingly placed on the first fixing portion;

the first and second shield frames being provided at the front ends of the first and second mounting portions thereof with first and second projecting pieces which forwardly project from the front ends, the first and second projecting pieces being fitted, as juxtaposed, in the engagement grooves in the edge frame in the transverse direction thereof.

According to the electrical connector having the arrangement mentioned above, the first projecting pieces and the second projecting pieces as juxtaposed are engaged with the engagement grooves in the edge frame, the first and second mounting portions are fittingly put on the body so that the end surfaces of the leg portions abut on each other, and the first fixing portion is overlappingly placed on the second fixing portion so that the engagement portions are engaged with the portions to be engaged. Thus, the first and second shield frames are connected to each other at the front and rear ends thereof and surround the body. Thus, the structure for fixing the frames to the body does not prevent the body from being made thin. Therefore, the walls of the body can be made thin. This meets the demand for a thinner electrical connector, thus enabling the electrical connector to be made in a compact design.

The electrical connector in accordance with another embodiment of the present invention further comprises:

contact-piece holding holes formed in two opposite walls of the body, the holes extending in the front-to-back direction of the body;

openings formed in the walls at their parts corresponding to the contact-piece holding holes except for the front and rear ends thereof, and through which the inside space of the body communicates with the contact-piece holding holes;

contact-piece supporting walls located at the front sides of the openings;

terminal supporting walls located at the rear sides of the openings;

contact-piece members having (i) terminal portions secured in the contact-piece holding holes at positions thereof corresponding to the terminal supporting walls, and (ii) contact-piece portions forwardly extending from the terminal portions and having tips supported by the terminal supporting walls in the contact-piece holding holes; and contact areas formed in an arcuate shape at the contact-piece portions of the contact-piece members, the contact areas projecting to the inside space of the body through the openings.

In the electrical connector having the arrangement mentioned above, the contact-piece portions of the contact-piece members are bent into an arcuate shape to form contact areas. Accordingly, it is enough to form, in the body, spaces for housing such arcuate contact areas. Therefore, even though the electrical connector is of the cantilever type, the spaces for housing the contact-piece members which are required to be formed inside of the body, can be narrowed as compared with a conventional electrical connector. Thus, the electrical connector of this embodiment can be made thin and in a compact design, likewise the electrical connector of the embodiment mentioned earlier.

In the electrical connector in accordance with a further embodiment of the present invention, the contact-piece holding holes formed in the walls of the body are opened, at the front side of the body, in the transverse width of each of the walls, and the parts of the contact-piece holding holes corresponding to the contact-piece supporting walls are formed as spaces which allow the tips of the contact-piece members to be displaced.

In the electrical connector having the arrangement above-mentioned, the contact-piece members can be smoothly displaced. Thus, the present invention can provide a cantilever-type electrical connector the life-time of which is long.

In the electrical connector in accordance with still another embodiment of the present invention, the first shield frame is integrally provided at the rear side of the first fixing portion thereof with holding pieces, the second shield frame is integrally provided at the rear side of the second fixing portion thereof with projecting pieces, a shield layer of a signal cable folded back on an outer armor thereof is held by and between the holding pieces of the first shield frame, and the projecting pieces of the second shield frame are held by and between the holding pieces and the shield layer.

In the electrical connector having the arrangement mentioned above, the first and second shield frames are securely connected to each other through the holding pieces and the projecting pieces, and electrically securely connected to a shield layer of a signal cable. Accordingly, the first and second shield frames are securely connected to each other at the rear ends thereof, and electrically securely connected to the shield layer of the signal cable. This improves the electrical connector in shielding performance.

In the electrical connector in accordance with a still further embodiment of the present invention, the first mounting portion of the first shield frame is put on one-half of the periphery of the body, the second mounting portion of the second shield frame is put on the other one-half of the periphery of the body, the end surfaces of the leg portions of the first mounting portion abut on the end surfaces of the leg portions of the second mounting portion, the first fixing portion is overlappingly placed on the second fixing portion, a metallic foil such as a copper foil is entirely wound on those parts of the shield frames to be molded, and a resin molded body is insert-molded on the outer periphery of the metallic foil.

In the electrical connector having the arrangement mentioned above, resin injected into the molds does not enter inside of the shield frame unit even though small bores have been formed in those parts of the shield frames to be bent in order to facilitate the bending operation. This enables a resin molded body to be insert-molded. Further, since the small bores are covered with the metallic foil, the shielding effect is improved.

Other features and operational effects of the present invention will be apparent from the following description of embodiments thereof with reference to the attached drawings.

DETAILED DESCRIPTION OF THE PREFERRED EMBODIMENT

Figure 3:
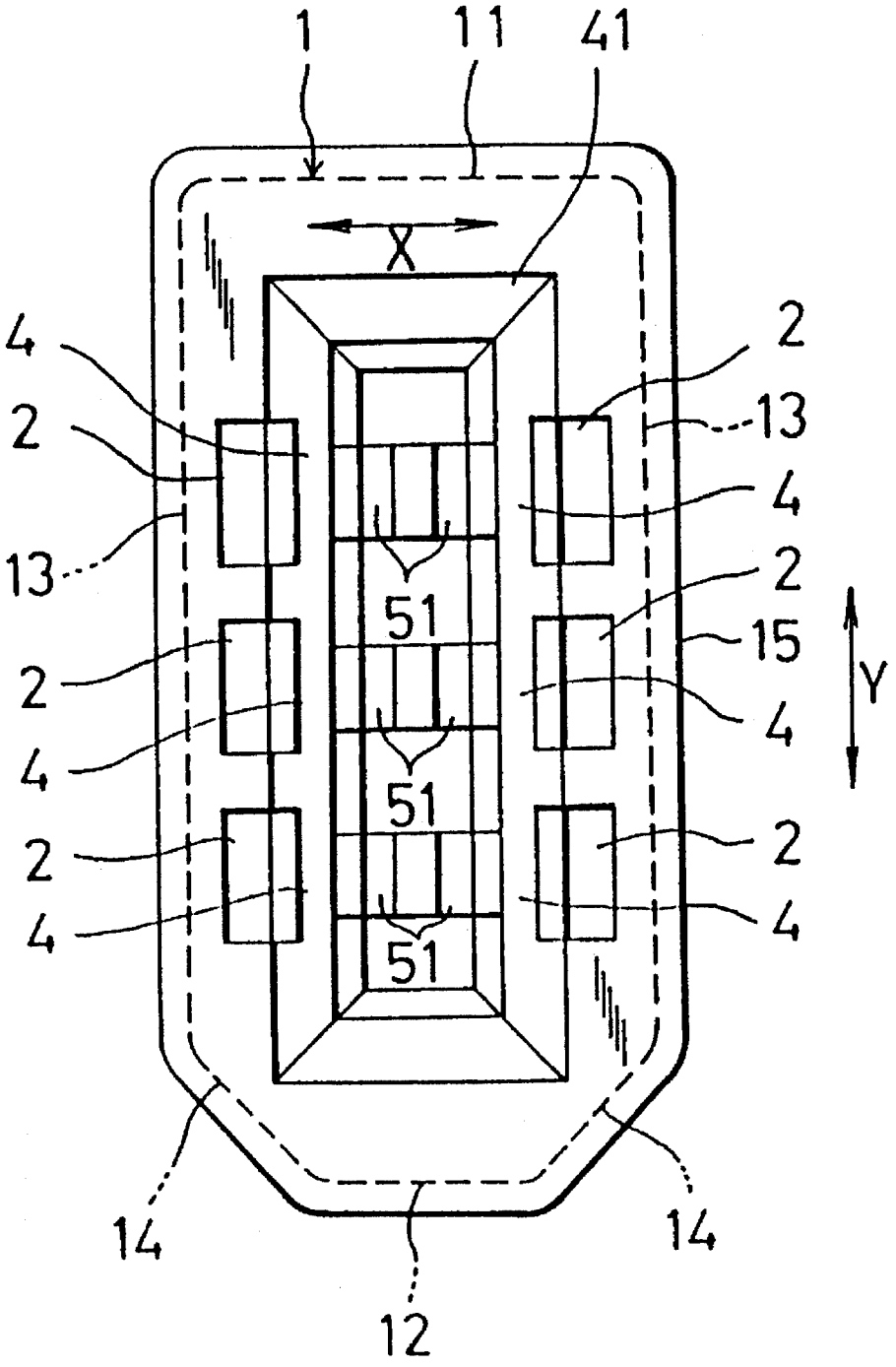
FIG. 3 is a front view of the electrical connector shown in FIG. 1.
Figure 4:
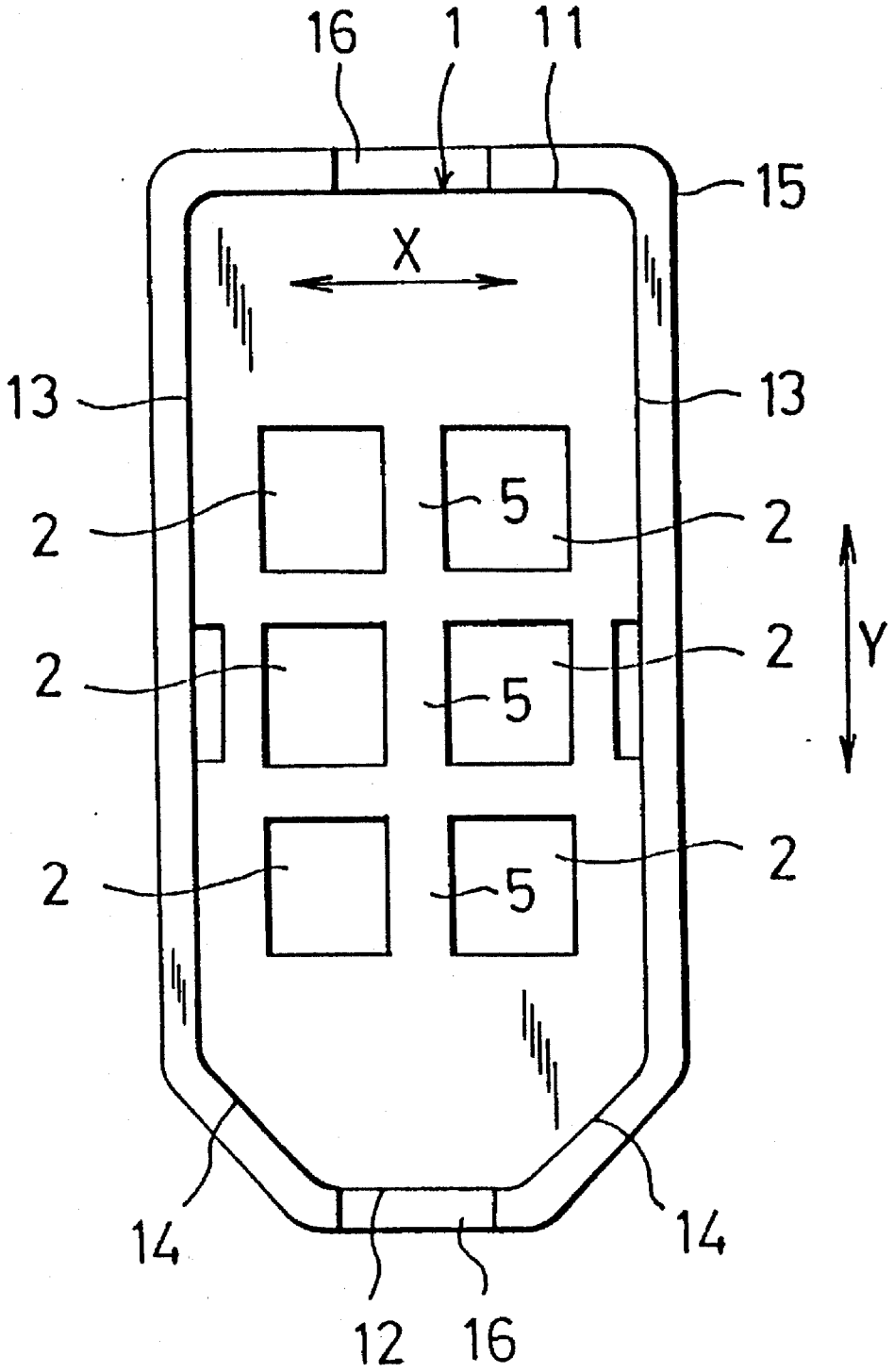
FIG. 4 is a back view of the body.

As shown in FIGS. 3 and 4, the electrical connector of the present invention has a body 1 in the form of a hollow rectangular parallelepiped comprising a top wall 11, a bottom wall 12 and lateral walls 13, the body 1 and the walls 11 to 13 being integrally formed from synthetic resin which is an insulator. Inclined portions 14 are formed at the boundary portions between the lateral walls 13 and the bottom wall 12. In the body 1, the width dimension in the transverse direction X is smaller than the thickness dimension in the vertical direction Y.

The body 1 is provided on the outer surface of the front end thereof with an outwardly projecting edge frame 15 which surrounds the top wall 11, the bottom wall 12, the lateral walls 13 and the inclined portions 14, the edge frame 15 being integrally formed with the body 1. The edge frame 15 is provided in the top and bottom portions thereof with engagement grooves 16 which are concave, i.e., recessed in the direction from the rear end of the edge frame 15 to the front end thereof. As apparent in FIG. 4, the groove bottoms of the engagement grooves 16 are flush with the surfaces of the top wall 11 and bottom wall 12.

Figure 5:
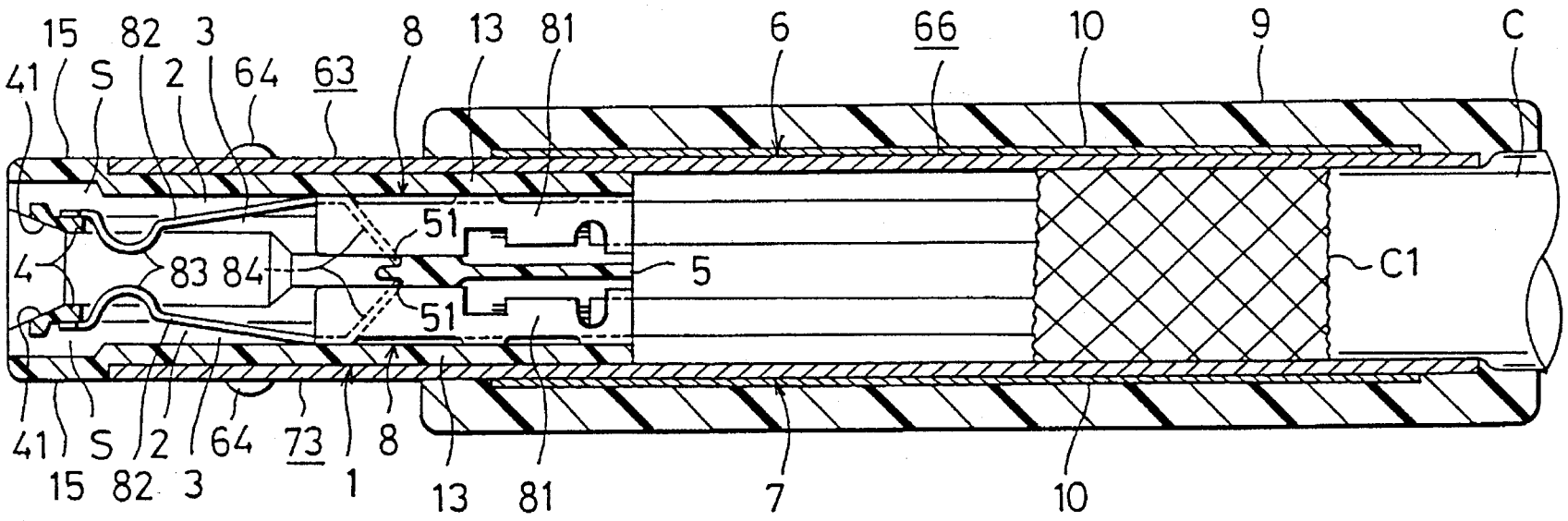
FIG. 5 is a transverse section view in plan elevation of the electrical connector shown in FIG. 1.

Each of the lateral walls 13 is provided in three parts thereof at regular spatial intervals in the vertical direction Y with three contact-piece holding holes 2 which extend into each lateral wall 13 in the front-to-back direction of the body 1. At those parts of the contact-piece holding holes 2 except for the front and rear ends thereof, openings 3 are formed in the lateral walls 13 as shown in FIG. 5. Contact-piece supporting walls 4 and terminal supporting walls 5 are respectively formed at the front and rear sides of the openings 3. In other words, when the body 1 is seen from the front side as shown in FIG. 3, in each of the lateral walls 13, the contact-piece holding holes 2 are opened in one row in the vertical direction Y, and those portions of the contact-piece holding holes 2 corresponding to the contact-piece supporting walls 4 serve as spaces S which allow the tips of contact-piece members 8 to be displaced therein. Also, when the body 1 is seen from the back side as shown in FIG. 4, the contact-piece holding holes 2 are opened in one row in the vertical direction Y in each of the lateral walls 13. As shown in FIG. 5 in which the body 1 is shown in a transverse section in plan elevation, the inside space of the body 1 communicates with the contact-piece holding holes 2 through the openings 3.

As shown in FIG. 5, the inner surfaces of the contact-piece supporting walls 4 are formed as inclined surfaces 41 which taper in the rearward direction. The inclined surfaces 41 serve as guide surfaces, enabling a counter electrical connector (not shown) to be smoothly guided into the inside space of the body 1. The terminal supporting walls 5 are provided at the front ends thereof with stepped portions 51.

The shield frame unit comprises a first shield frame 6 and a second shield frame 7.

Figure 1:
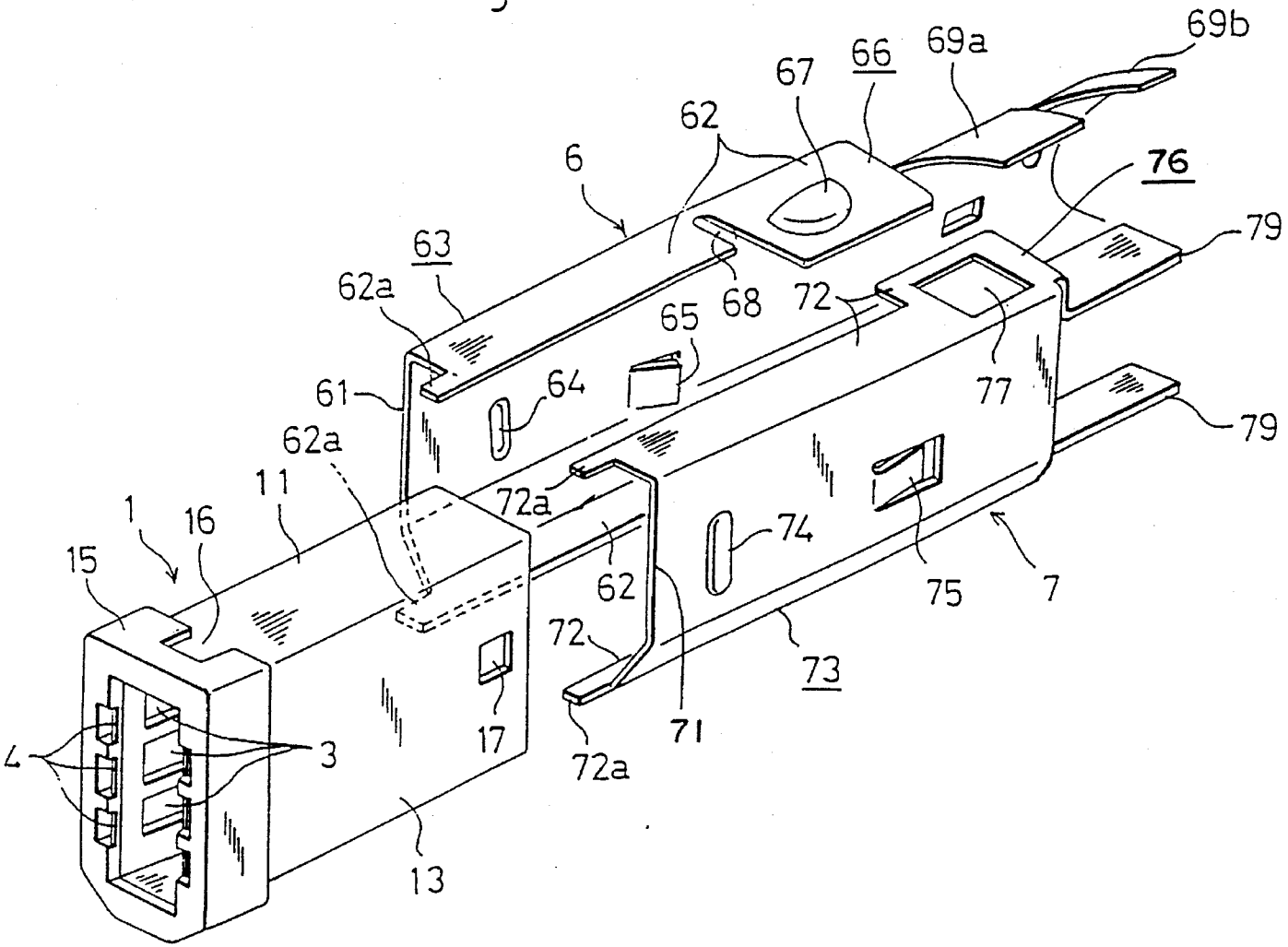
FIG. 1 is an exploded perspective view of the body and shield frame unit of an electrical connector according to an embodiment of the present invention.

The first shield frame 6 is so formed as to have a U-shaped section and comprises a plate-like portion 61 and a pair of leg portions 62 projecting inwardly from the longitudinal edges thereof throughout the length thereof. In the first shield frame 6, the front-half portion thereof is formed as a first mounting portion 63 which fits on one-half of the periphery of the body 1. In the first mounting portion 63, the plate-like portion 61 has a projection 64 and an inwardly cut-raised engagement pawl 65. In the first mounting portion 63, the leg portions 62 are provided at the front ends thereof with first projecting pieces **62*a*. The rear-half portion of the first shield frame 6 is formed as a first fixing portion 66 located at the rear side of the first mounting portion 63. In the first fixing portion 66, the leg portions 62 are provided at predetermined positions thereof with cutraised engagement portions 67. The leg portions 62 of the first fixing portion 66 project inwardly more than the leg portions 62 of the first mounting portion 63, and slit-like notches 68 are formed between the first fixing portion 66 and the first mounting portion 63. U-shaped holding pieces 69*a*, 69*b* for holding a signal cable are formed at the rear side of the first fixing portion 66. Preferably, the first mounting portion 63 and the first fixing portion 66 are substantially coplanar, as shown in FIG. 1**.

The second shield frame 7 is similar in configuration to the first shield frame 6. More specifically, the second shield frame 7 is so formed as to have a U-shaped section and comprises a plate-like portion 71 and a pair of leg portions 72 projecting inwardly from the longitudinal edges of the plate-like portion 71 throughout the length thereof. In the second shield frame 7, the front-half portion thereof is formed as a second mounting portion 73 which fits on the other one-half of the periphery of the body 1. In the second mounting portion 73, the plate-like portion 71 has a projection 74 and an inwardly cut-raised engagement pawl 75. In the second mounting portion 73, the leg portions 72 are provided at the front ends thereof with second projecting pieces **72*a*. The rear-half portion of the second shield frame 7 is formed as a second fixing portion 76 located at the rear side of the second mounting portion 73. In the second fixing portion 76, the leg portions 72 are provided in predetermined positions thereof with rectangular engagement holes 77. The leg portions 72 of the second fixing portion 76 project inwardly more than the leg portions 72 of the second mounting portion 73. Projecting pieces 79 extend from the rear end of the second fixing portion 76. Preferably, the second mounting portion 73 and the second fixing portion 76 are substantially coplanar, as shown in FIG. 1**.

Figure 2:
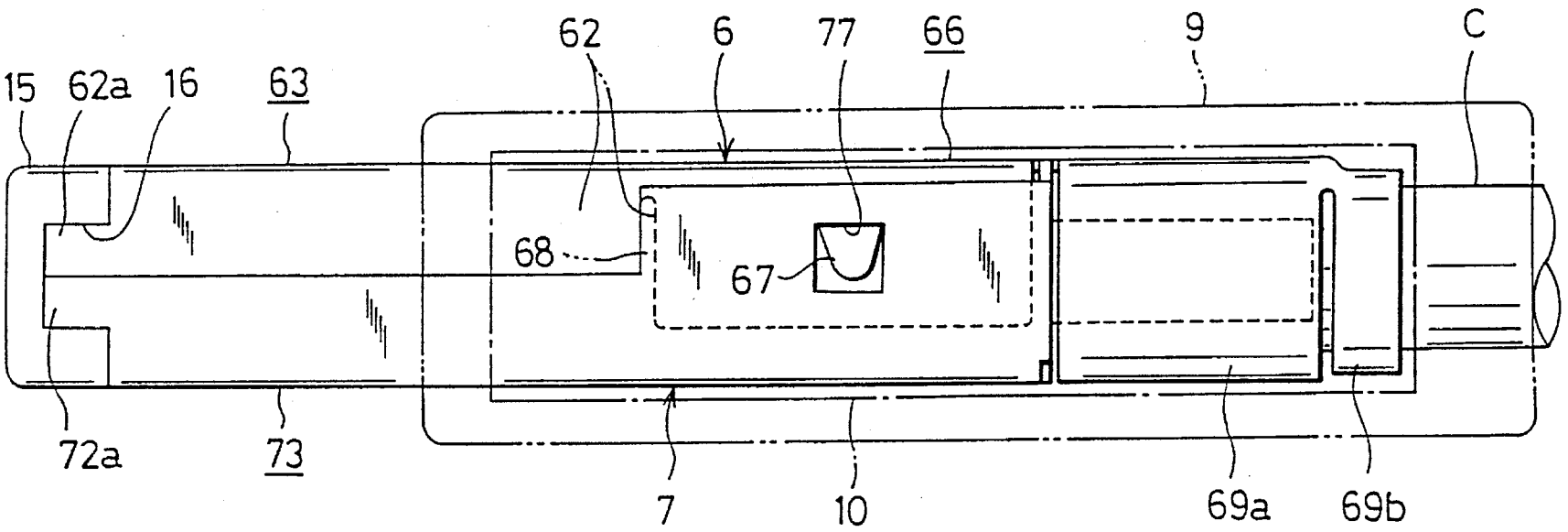
FIG. 2 is a plan view of the electrical connector in FIG. 1, illustrating how the body is surrounded by the shield frame unit.

In the first and second shield frames 6, 7, the end surfaces of the leg portions 62 of the first mounting portion 63 fitted to the one-half of the periphery of the body 1, abut on the end surfaces of the leg portions 72 of the second mounting portion 73 fitted to the other one-half of the periphery of the body 1. The outer surfaces of the leg portions 62 of the first fixing portion 66 are engaged with the inner surfaces of the leg portions 72 of the second fixing portion 76, and the engagement portions 67 are fitted into the engagement holes 77. Thus, the rear end portions of the first and second shield frames 6, 7 are connected to each other. As shown in FIG. 2, the first projecting pieces **62*a* and the second projecting pieces 72*a* are fitted, as juxtaposed, into the engagement grooves 16 in the edge frame 15 of the body 1, thus preventing the front ends of the first and second shield frames 6, 7 from being separated from each other. As shown in FIG. 5, a shield layer C1 of a signal cable C folded back on an outer armor thereof is held by and between the holding pieces 69*a*, 69*b* of the first shield frame 6. The projecting pieces 79 of the second shield frame 7 are placed inside of the holding pieces 69*a*, 69*b*. Accordingly, the first and second shield frames 6, 7 are securely connected to each other through the holding pieces 69*a*, 69*b* and the projecting pieces 79, and electrically securely connected to the shield layer C1 of the signal cable C. The engagement pawls 65, 75 are engaged with engagement concaves 17 in the body 1**.

When the first and second shield frames 6, 7 are connected to each other at the front and rear ends thereof in the manner mentioned above, the frames 6, 7 are not separated from each other even though the electrical connector of the present invention is frequently inserted into and removed from a counter electrical connector. Further, the shield frames 6, 7 are not separated from each other during the transportation of the electrical connector of the present invention.

As shown in FIG. 5, the contact-piece members 8 have, in a unitary structure, terminal portions 81 and contact-piece portions 82 extending forwardly therefrom. The contact-piece portions 82 have arcuate contact areas 83. The contact-piece members 8 having the arrangement mentioned above are respectively inserted in the contact-piece holding holes 2. More specifically, the contact-piece members 8 are assembled by insertion from the back-side openings of the contact-piece holding holes 2 into the contact-piece holding holes 2. When the contact-piece members 8 are assembled, the tips of the contact-piece portions 82 resiliently come in contact with and are supported by the contact-piece supporting walls 4 in the contact-piece holding holes 2, and the terminal portions 81 are secured in the contact-piece holding holes 2 at their positions corresponding to the terminal supporting walls 5, and the contact areas 83 project into the inside space of the body 1 through the openings 3. The contact-piece members 8 have engagement pawls 84. The engagement pawls 84 are engaged with the stepped portions 51 of the terminal supporting walls 5, thus preventing the contact-piece members 8 from being pulled out from the contact-piece holding holes 2. The signal lines of the signal cable C are connected to the terminal portions 81.

The body 1 is assembled with the contact-piece members 8 and the first and second shield frames 6, 7, and the signal lines of the signal cable C are connected to the terminal portions 81 of the contact-piece members 8, and the signal cable C being held by and between the holding pieces 69*a*, 69*b*. Then, a resin-molded body 9 serving as a grip is molded at predetermined portions of the shield frames 6, 7 as shown in FIGS. 2 and 5. When insert-molding the resin-molded body 9, it is preferable that a metallic foil 10 such as a copper foil is wound on the portions of the shield frames 6, 7 to be molded, before resin is injected into molds. More specifically, it is a common practice that, in order to facilitate the bending operation, small bores are formed in those portions of the shield frames 6, 7 to be bent. Therefore, small bores remain opened in these portions. Relatively great gaps are formed between the first fixing portion 66 and the holding pieces 69*a*, 69*b*. If such small bores remain opened and such great gaps are formed, this involves the likelihood that injected resin enters inside of the shield frames 6, 7. The metallic foil 10 wound on the shield frames 6, 7 not only prevents such entrance of the resin, but also reinforces the shielding effect.

Figure 6:
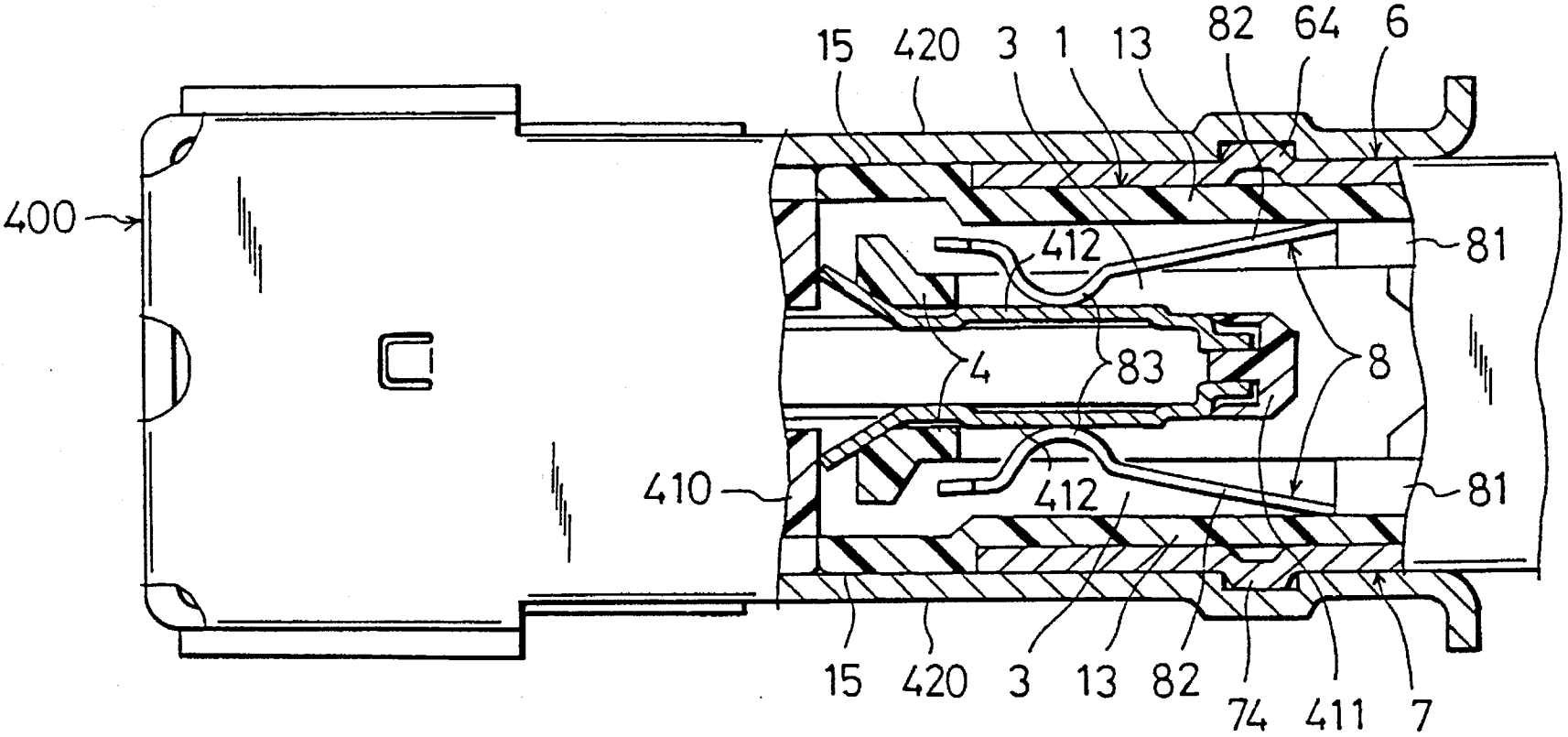
FIG. 6 is a transverse section view in plan elevation of the electrical connector shown in FIG. 1 as connected to a counter electrical connector.
Figure 7:
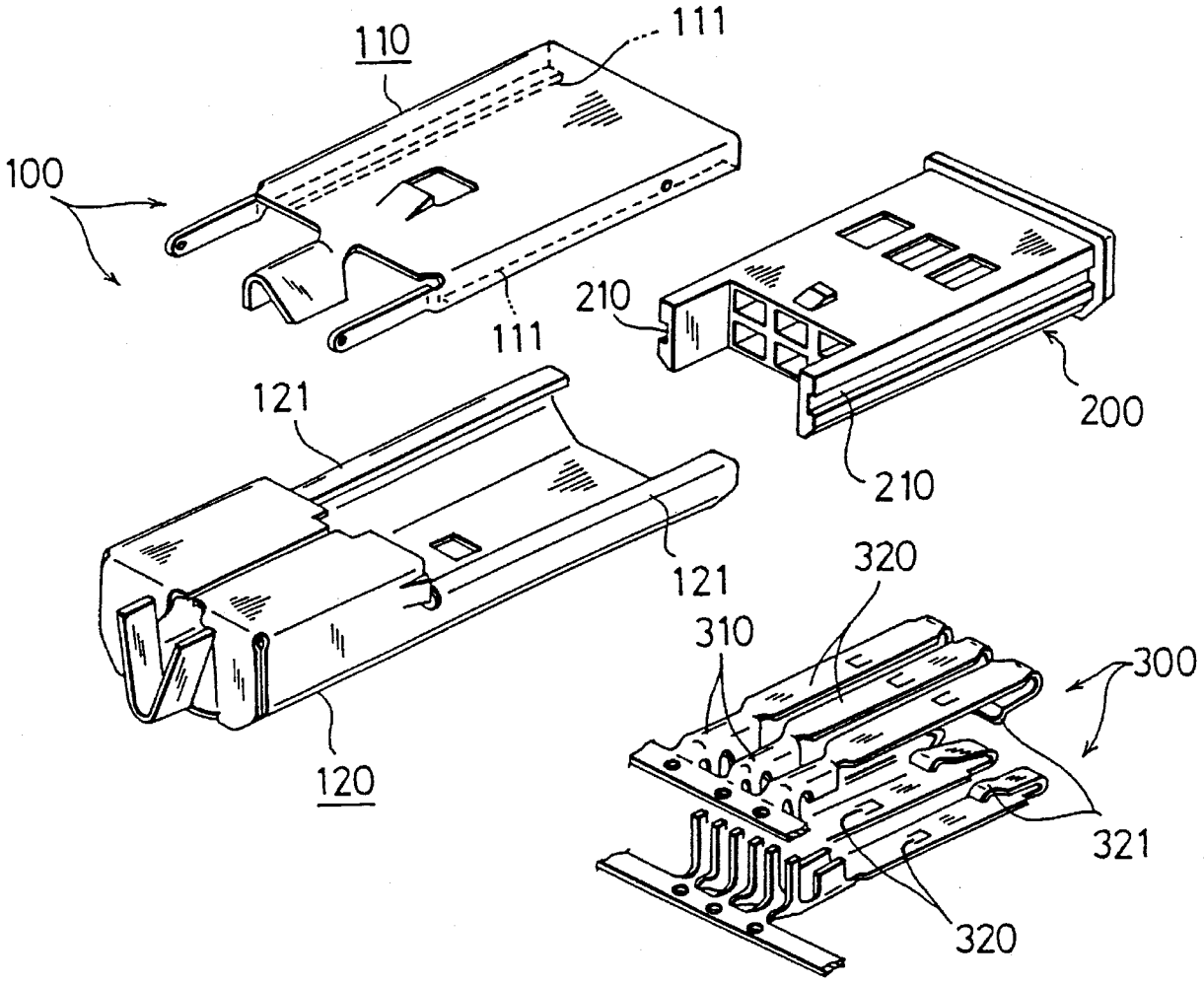
Fig. 7 (Prior Art)
FIG. 7 is an exploded perspective view of a conventional electrical connector.

FIG. 6 shows the electrical connector of the embodiment mentioned above to which a counter electrical connector 400 is connected by insertion thereinto. As shown in FIG. 6, the counter electrical connector 400 has a body 410 and a shield frame 420 surrounding the body 410. Contact areas 412 of contact-pieces members are disposed at both sides of a contact-piece holding portion 411 of the body 410. Accordingly, the contact areas 83 of the contact-piece members 8 in the electrical connector of the present invention are deformed as pushed and bent backward in the inside of the contact-piece holding holes 2 by the contact areas 412 of the counter electrical connector 400. Thus, the contact areas 83 resiliently come in contact with the contact areas 412 of the counter electrical connector.

What is claimed is:

1. An electrical connector for engagement with a mating electrical connector, the mating electrical connector having contacts, said electrical connector comprising:

a body made in the form of a hollow rectangular parallelpiped, said body defining an interior space, a front end, a back end, and outer peripheral walls;

contact-piece members incorporated in said body and adapted to contact the contacts of a mating electrical connector inserted into the interior space of said body;

an edge frame formed at the outer peripheral walls of the front end of said body, said edge frame projecting outwardly from said body, surrounding walls of said edge frame, including top and bottom walls, each of said top and bottom walls having a transverse direction and defining a front end and a rear end;

an engagement groove formed in each of said top and bottom walls of said edge frame, said engagement grooves being recessed in the direction from the rear end of said edge frame to the front end thereof;

a first U-shaped shield frame formed in a unitary structure, comprising a plate-like portion having two longitudinal edges, and a pair of leg portions projecting inwardly from the longitudinal edges of the plate-like portion throughout the length thereof, each the leg portion of the first U-shaped shield frame defining a first mounting portion, the first mounting portion defining a projecting piece at a front end, a rear side and end surfaces, and a first fixing portion integral with the rear side of the first mounting portion, the first fixing portion being provided with an engagement portion the first mounting portion and the first fixing portion fitted on one half of the outer peripheral walls of the body; and a second U-shaped shield frame formed in a unitary structure, comprising a plate-like portion having two longitudinal edges, and a pair of leg portions projecting inwardly from the longitudinal edges of the plate-like portion throughout the length thereof, each the leg portion of the second U-shaped shield frame defining a second mounting portion, each of the second mounting portions defining a projecting piece at a front end, a rear side and end surfaces, and a second fixing portion integral with the rear side of the second mounting portion, the second fixing portion being provided with an opening for engagement with a projection of the corresponding engagement portion of the first fixing portion, the second mounting portion and the second fixing portion fitted on the other half of the outer peripheral surface of the body wherein:

the end surfaces of each the first mounting portion, abut against the end surfaces of each the second mounting portion;

each the second fixing portion being overlappingly placed on the first fixing portion;

the projecting pieces of the first mounting portion and the second mounting portion being fitted, as juxtaposed, in the engagement grooves in the edge frame;

the first mounting portions having a greater longitudinal extent than the first fixing portions, and the second mounting portions having a greater longitudinal extent than the second fixing portions;

each of the first and second mounting portions being substantially coplanar with their respective fixing portion;

the first U-shaped shield frame is integrally provided adjacent to the first fixing portions thereof with U-shaped holding pieces;

the second U-shaped shield frame is integrally provided adjacent to the second fixing portions thereof with projecting pieces;

a shield layer of a signal cable adapted to fold back on an outer armor thereof, the shield layer being held by and between the holding pieces of the first shield frame; and the projecting pieces of the second shield frame are held by and between the holding pieces and the shield layer.

2. An electrical connector according to claim 1, wherein the thickness dimension of the body in the vertical direction is greater than the width dimension of the body in the transverse direction.

3. An electrical connector according to claim 1, wherein:

the leg portions define a longitudinal extent and a transverse extent;

the engagement portions of the first fixing portions are formed in the leg portions defining the first fixing portions, in a projecting manner, by cutting and raising parts of the leg potions, and the portions to be engaged of the second fixing portions are made in the form of engagement holes formed in the leg potions defining the second fixing portions; and the leg portions defining the first fixing portion extend transversely inwardly to a greater extent than the leg portions defining the first mounting portions, and the leg portions defining the second fixing portion project inwardly to a greater extent than the leg portions defining the second mounting portions.

4. An electrical connector according to claim 1, further comprising:

contact-piece holding holes formed in two opposite walls of the body, the contact-piece holding holes extending in the direction of the front-to-back ends of the body;

openings formed in opposite walls of the body and located to correspond to the contact-piece holding holes except for the front and rear ends thereof, and through which the interior space of the body communicates with the contact-piece holding holes;

contact-piece supporting walls located at the front sides of the openings;

terminal supporting walls located at the rear sides of the openings;

contact-piece members having terminal portions secured in the contact-piece holding holes at positions thereof corresponding to the terminal supporting walls, and contact-piece portions extending forwardly from the terminal portions and having tips supported by the terminal supporting walls in the contact-piece holding holes; and contact areas formed in an arcuate shape at the contact-piece portions of the contact-piece members, the contact areas projecting into the interior space of the body through the openings.

5. An electrical connector according to claim 4, wherein the inner surfaces of the contact-piece supporting walls are formed as inclined surfaces which taper in the direction from the front end to the rear end of the body.

6. An electrical connector according to claim 4, wherein:

the contact-piece holding holes have parts corresponding to the contact-piece supporting walls;

the contact-piece holding holes formed in the opposite walls of the body are opened, at the front end of the body, in the transverse width of each of the walls, and the parts of the contact-piece holding holes corresponding to the contact-piece supporting walls are formed as spaces which allow the tips of the contact-piece members to be displaced.

7. An electrical connector according to claim 1, wherein:

a metallic foil such as a copper foil, and having an outer periphery, is entirely wound on parts of the U-shaped shield frames to be molded; and a resin molded body is insert-molded on the outer periphery of the metallic foil.

8. An electrical connector according to claim 4, wherein:

a metallic foil such as a copper foil, and having an outer periphery, is entirely wound on parts of the U-shaped shield frames to be molded; and a resin molded body is insert-molded on the outer periphery of the metallic foil.

9. An electrical connector according to claim 6, wherein:

a metallic foil such as a copper foil, and having an outer periphery, is entirely wound on parts of the U-shaped shield frames to be molded; and a resin molded body is insert-molded on the outer periphery of the metallic foil.

10. An electrical connector according to claim 7, wherein:

a metallic foil such as a copper foil is entirely wound on parts of the U-shaped shield frames to be molded; and a resin molded body is insert-molded on the outer periphery of the metallic foil.

* * * * *

UNITED STATES PATENT AND TRADEMARK OFFICE

CERTIFICATE OF CORRECTION

PATENT NO. : 5,456,618

DATED : October 10, 1995

INVENTOR(S) : Masahiko Nakamura

It is certified that error appears in the above-indentified patent and that said Letters Patent is hereby corrected as shown below:

Claim 1, column 7, line 60, "lelpiped" should be "lelepiped"; and column 8, line 1, the "," (second occurrence) should be deleted.

Claim 3, column 9, line 7, "potions" should be "portions"; and line 9, "potions" should be "portions".

Claim 10, column 10, line 37, "7" should be "1".

Signed and Sealed this

Eleventh Day of June, 1996

*Attest:*

Bruce Lehman

BRUCE LEHMAN

*Attesting Officer*

*Commissioner of Patents and Trademarks*